United States Patent [19]

Ingram

[11] Patent Number: 4,777,705

[45] Date of Patent: Oct. 18, 1988

[54] SHOE FASTENER

[76] Inventor: Oran D. Ingram, 6744 E. Sheridan, Scottsdale, Ariz. 85257

[21] Appl. No.: 115,395

[22] Filed: Nov. 2, 1987

[51] Int. Cl.[4] ..... A43C 1/00

[52] U.S. Cl. ..... 24/143 A; 24/140

[58] Field of Search ..... 24/143 A, 143 R, 144, 24/148, 141, 142, 140, 147, 117 R, 117 A, 118, 119, 120, 115 R, 121; 36/50

[56] References Cited

U.S. PATENT DOCUMENTS

| | | | |
|---|---|---|---|
| 345,494 | 7/1886 | Florsheim | 24/144 |
| 451,420 | 4/1891 | LaDow | 24/148 |
| 758,001 | 4/1904 | Dixon, Sr. | 24/140 |
| 912,900 | 2/1909 | Shafer | 24/117 R |
| 1,211,544 | 1/1917 | Cheney | 24/117 R |
| 1,296,529 | 3/1919 | Koester | 24/140 |
| 1,595,630 | 8/1926 | Stockton | 24/140 |
| 1,600,851 | 9/1926 | Sego | 36/50 |
| 1,898,225 | 2/1933 | Szabo | 36/50 |
| 1,966,135 | 7/1934 | Reh | 36/50 |
| 1,989,418 | 1/1935 | Hertzberg | 24/143 A |

FOREIGN PATENT DOCUMENTS

| | | | |
|---|---|---|---|
| 1183493 | 7/1959 | France | 36/50 |

*Primary Examiner*—Victor N. Sakran

*Attorney, Agent, or Firm*—Cahill, Sutton & Thomas

[57] ABSTRACT

A fastener replacing the laces in a shoe. The fastener is comprised of a strip of soft, elastomeric plastic material having openings near its ends for receiving posts on button members which also pass through shoe lace holes. The distal ends of the button posts have enlargements thereon which are received in retainer members which are snapped onto the posts after the latter are in place in the shoe. The buttons and retainer members are also preferably molded of elastomeric plastic material.

6 Claims, 1 Drawing Sheet

SHOE FASTENER

TECHNICAL FIELD

This invention is concerned with fasteners intended to replace string laces in shoes, such as athletic shoes.

BACKGROUND ART

It was suggested some time ago that replacing the normally inelastic lace of a shoe with a single elastic lace or a plurality of elastic laces should make it possible to insert the foot into the shoe and remove the foot from the shoe without untying or loosening the lace. See, for example, U.S. Pat. No. 1,898,225 granted Feb. 21, 1933 to L. G. Szabo for "SHOE LACE". This patent suggests the use of a single lace or a series of laces made entirely of rubber and having lateral heads at the ends of the laces. One of the deficiencies of the Szabo lace is that the soft rubber lateral heads on the ends of the laces cannot be relied upon to hold the ends of the laces in engagement with the shoe. There is a strong tendency for the lateral heads to collapse and pull out of the shoe lace holes in the shoes.

An earlier U.S. Pat. No. 1,595,630, granted Aug. 10, 1926 to R. F. Stockton for "SHOE SPRING LACE", discloses the use of a series of helical springs to connect opposed shoe opening eyelets. U.S. Pat. No. 1,966,135 granted July 10, 1934 to M. Reh for "RESILIENT GRIP FOR SHOES" proposes, for a similar purpose, the use of two loops of elastic material connected by a metal link and washers, or disks, to prevent the loops from pulling through the shoe eyelets. Although possibly more reliable than the Szabo lace, the Stockton and Reh lace replacements are both fairly complex and expensive to manufacture.

There continues to be a need for an inexpensive and reliable shoe fastener to replace conventional laces and permit the foot to be inserted in and removed from the shoe without undoing the fastener.

DISCLOSURE OF THE INVENTION

This invention contemplates the use of strips of soft elastomeric plastic material as the body of the shoe fasteners. At the ends of each such strip there are openings through which a post on a button is received. The button posts are adapted to pass through opposed openings on the shoe to connect the strips to the shoe. Enlargements on the ends of the posts are received in cavities in retainer members which are snapped onto the posts and grip the enlargements on the posts after the latter are in place in the shoe lace openings.

BRIEF DESCRIPTION OF THE DRAWINGS

The invention is described in greater detail hereinafter by reference to the accompanying drawings, wherein.

BEST MODE FOR CARRYING OUT THE INVENTION

Figure 1:
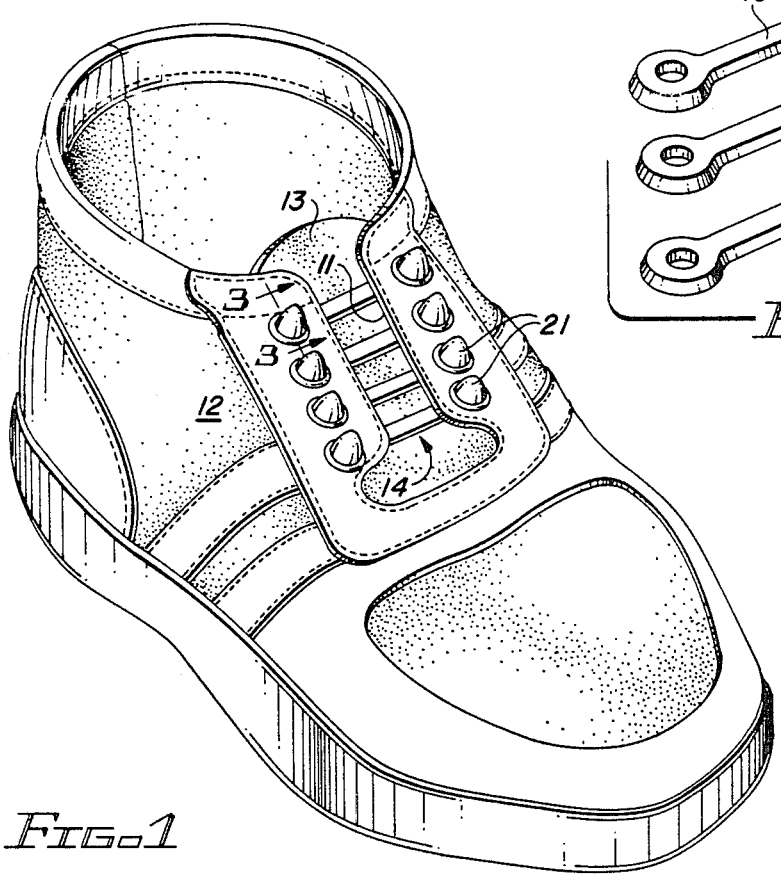
FIG. 1 is a perspective view of a shoe equipped with fasteners made in accordance with this invention.

Referring particularly to FIG. 1, there shown is a shoe of the type which can utilize fasteners constructed in accordance with this invention. The shoe is conventional in construction having an elongated opening 11 in the upper portion 12 beneath which lies a tongue 13. Arranged alongside each edge of opening 11 are a series of lace holes (not visible in this view) through which a conventional string lace normally is threaded. The holes commonly are arranged in opposite pairs and may or may not be reinforced with eyelets.

In accordance with this invention, the conventional shoe lace is replaced by a series of fasteners indicated generally by reference number 14.

Figure 2:
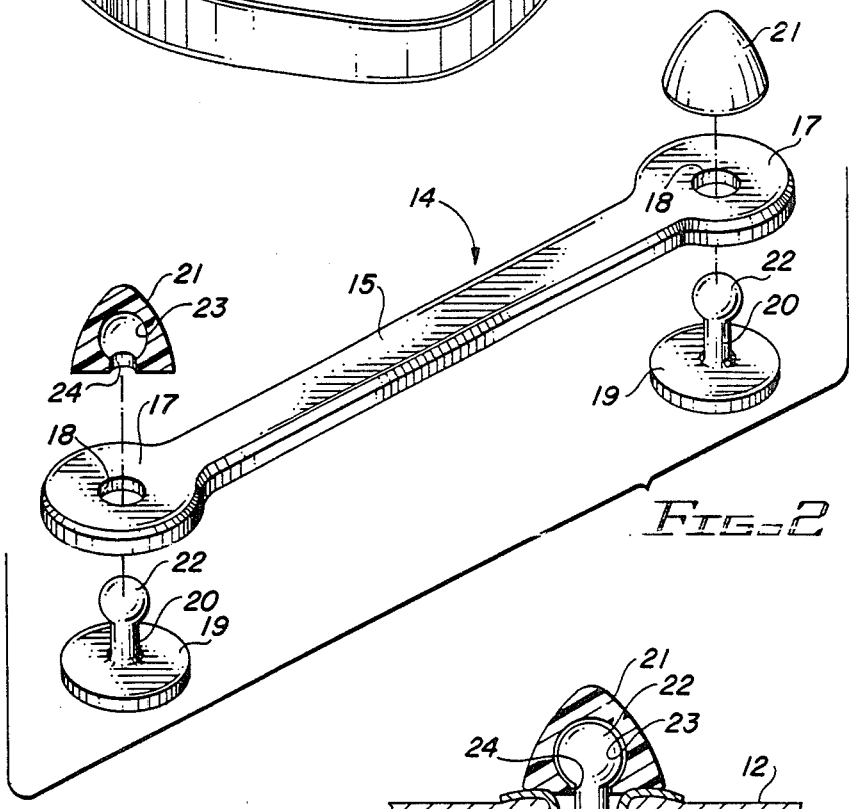
FIG. 2 is an enlarged, exploded view of the fastener of this invention.

The several components of each fastener are illustrated in FIG. 2. The main component of the fastener is a flat strip 15 of elastomeric material. Strip 15 is preferably molded from a soft, elastic plastic material, such as polyurethane plastic, having a room temperature durometer of approximately 30 to 40. Each strip 15 preferably has an intermediate region 16 of substantially uniform width and wider end regions 17. Each end region 17 has a hole 18 therethrough by which the strip is affixed to and retained on the shoe.

The means for retaining each fastener strip 15 on the shoe comprises a pair of buttons, or button-like members, 19 having posts 20 projecting from one face of the base thereof for engagement by retainer members 21. The distal end of each button post 20 has an enlargement 22 thereon adapted to be retained in a cavity 23 in a retainer member 21. Each retainer member 21 has a somewhat conical configuration to provide a broad base and a narrow upper portion. Entry to cavity 23 is provided by an opening 24 in the base of each retainer member 21, which opening has a diameter that is less than the enlargement 22 on button post 20 and which is approximately the same diameter as the remainder of the post. Thus, each retainer member 21 is adapted to be snapped onto and over the enlargement 22 on a button post 20.

To facilitate the snap joinder of retainer members 21 and button post 20, the retainer members 21 or the buttons 19 or both should be made of resilient material. For convenience of manufacture the buttons 19 and the retainer members 21 can be molded of the same polyurethane plastic material as the strips 15. However, if desired, a slightly different plastic material formulation can be selected for either the buttons 19 or the retainer members 21 or both to make these components somewhat less resilient. Additional stiffness for the buttons 19 and the retainer members 21 can make separation of these elements more difficult and improve the reliability of the fasteners 14.

Figure 3:
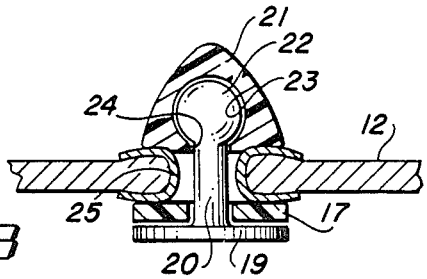
FIG. 3 is a sectional view through the retainer mechanism of the fastener of FIG. 2.

The manner in which a fastener 14 is affixed to the shoe upper portion 12 is illustrated in FIG. 3. Note that button 19 has its post 20 projecting through hole 18 in one end of strip 15 and upwardly through an eyelet 25 making a lace hole in the shoe upper 12. A retainer member 21 engaged in place over the enlargement 22 on the end of button post 20 firmly affixes the strip in place beneath the shoe upper and above the shoe tongue 13.

With a series of fasteners 14 in place on the shoe in the manner illustrated in FIG. 1 it is possible to stretch the fasteners to enlarge shoe opening 11 for insertion and removal of the foot. Because of the extensibility and elasticity of the fastener strips 15, the fasteners 14 need not be disconnected to insert or remove the foot. Moreover, the reliable connections provided by retainer members 21 and buttons 19 insure that the shoe will be held in place on the foot once the foot is in place.

Figure 4:
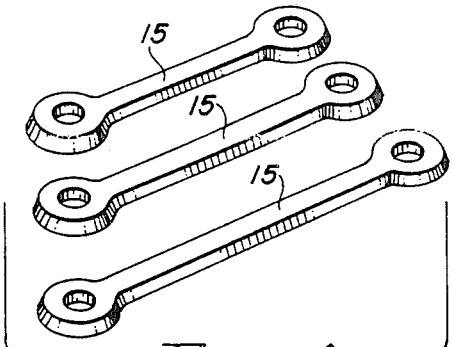
FIG. 4 is a perspective view of a set of strips used in fasteners of this invention.

It should be recognized that the spacing between opposite lace holes along the edges of shoe upper opening 11 may vary along the opening depending on the cut of the shoe and the shape of the wearer's foot. To compensate for this it is desireable to provide a set of fastener strips 15 of different lengths as shown in FIG. 4 with each fastener kit. The shoe owner need only note where the lace holes are farther apart or closer together when the shoe is laced on the foot. When substituting fasteners 14 for the lace formerly employed the owner places the longer fastener strips 15 where the holes are farther apart and the shorter fastener strips where the holes are closer together.

What is claimed is:

1. A set of shoe fastener, each fastener comprising a strip of soft, elastic plastic material, said strip having openings therethrough near its opposite ends, a pair of button members each having a base and a post extending away from the base, said button members being molded from an elastomeric plastic material each said post having an enlargement at its distal end, the post of said button members being adapted to extend through the openings in said strip and through lace holes in a shoe upper for connecting the strip between opposite holes, and a pair of retainer members, said retainer members being adapted to be snap fitted over the enlargements on said posts for retaining said posts in said holes.

2. The shoe fastener of claim 1 further characterized in that each of said retainer members has a cavity therein for receiving the enlargement on one of said posts.

3. The shoe fastener of claim 2 further characterized in that each of said retainer members has a conical configuration with the entrance to the cavity therein in the base of the cone.

4. The shoe fastener of claim 2 further characterized in that said retainer members are molded of an elastomeric plastic material.

5. The shoe fastener of claim 1 further characterized in that said strip is wider at its ends where said openings are located than in the region intermediate its ends.

6. A set of shoe fasteners characterized as set forth in claim 1 wherein the set includes at least one strip which has the openings therein spaced a greater distance than the openings in another strip.

* * * * *